US007249866B1

(12) United States Patent
Tai

(10) Patent No.: US 7,249,866 B1
(45) Date of Patent: Jul. 31, 2007

(54) ORGANIZING AND INSTALLATION DEVICE FOR ICICLE LIGHTS

(76) Inventor: Daniel Tai, 4519 Hatch La., Lisle, IL (US) 60532

( * ) Notice: Subject to any disclaimer, the term of this patent is extended or adjusted under 35 U.S.C. 154(b) by 0 days.

(21) Appl. No.: 11/419,487

(22) Filed: May 19, 2006

(51) Int. Cl.
*F21V 21/00* (2006.01)

(52) U.S. Cl. ..... 362/249; 362/252; 362/396; 362/147; 362/806

(58) Field of Classification Search ..... 362/249, 362/253, 806, 396, 147; 248/74.2, 339; 211/181.1
See application file for complete search history.

(56) References Cited

U.S. PATENT DOCUMENTS 6,076,938 A 6/2000 Kinderman
2002/0105281 A1* 8/2002 Openiano ..... 315/185 R
2004/0145894 A1* 7/2004 Long ..... 362/249

* cited by examiner

*Primary Examiner*—Thomas M. Sember

(57) ABSTRACT

An organizing and installation device for Icicle lights has a hanging assembly. The device includes a hanging unit having a plurality of rods which are arranged vertically and approximately in parallel; wherein at a top of each rod is connected with an upper wire; and a lower end of each rod is connected with a lower wire. Each rod is installed with a plurality of clips or other fastening devices. A plurality of upper support clips are arranged on the upper wire; and a lower stabilizing clip has a connecting wire to connect the lower clip to the lower wire or rod. The upper and lower wires are made of flexible materials for easy installation around the corner and easy folding away storage. The upper support clip has two clamping tongues and a wire organizing space; and the space has a flexible notch to receive and release electrical and upper wire. The clips or other fastening devices on rod are elastic C-rings, adhesive tapes, velcro, flexible string or snap-on clips.

5 Claims, 11 Drawing Sheets

ORGANIZING AND INSTALLATION DEVICE FOR ICICLE LIGHTS

BACKGROUND OF THE INVENTION

The present invention relates to a decorative lighting, and in particular to Icicle lights, wherein the lights and a hanging unit are well defined so that they will not intertwine disorderly or even be blown onto the roof or gutter by strong winds. More specifically, this invention relates to a device used for organizing, installing, displaying, and storing the Icicle lights.

Icicle lights are popular in some festivals, such as Christmas and New Year to present beautiful decorations. They are usually installed outside during winter, the strong winds often cause these lights to intertwine or flip-up onto the roof. They are not able to hang straight. After the season, they are difficult to be stored in a neat and organized manner.

DESCRIPTION OF THE PRIOR ART

Referring to FIG. 1, the prior art installation of Icicle lights are formed of a plurality of vertical lights streams 12. The vertical lights streams 12 are attached to the edge of a roof 9 or a gutter of a roof 9 by clamps 13. However this prior art has the following disadvantages.

Firstly, only the top ends of lights streams are attached to a lateral plate 91, while the lower end of lights streams are not fixed. The lights streams 12 hang down naturally. As a result, they don't hang straight and are easy to intertwine together to present an undesired look.

Secondly, when strong winds blow, the lights streams 12 will flip-up unto the roof or gutter and get tangled together.

Another example of the installation device is described in prior art U.S. Pat. No. 6,076,938. As shown in FIG. 2, This prior art has a horizontal rod 14 which can be interconnected to extend the span and a plurality of vertical rods 25 which are suspended from the horizontal rod. A shingle-gutter member 35 is used to engage shingle or gutter. However this prior art has the following disadvantages.

Firstly, the horizontal rod is not flexible enough to be installed continuously around corners or peaks of the roof or fold away for easy storage.

Secondly, the shingle-gutter member has a tongue of straight plate. It can come loose under weights and strong winds. Plus, it can engage with shingle and gutter only and lacks the ability to install on fences, tree limbs and sidings.

Thirdly, it lacks the device to secure the bottom of the lights to prevent flip-up onto the roof.

Fourthly, the complexity of this frame device costs too high, therefore, hinder the popularity of the use of Icicle lights.

Therefore, a flexible, low cost, all purpose organizing and installation device is needed.

SUMMARY OF THE INVENTION

Accordingly, the primary object of the present invention is to provide the Icicle lights an organizing and installation device, wherein the Icicle lights and hanging unit are well defined so that they will not intertwine or flip-up on to the roof, and can be folded away orderly for storage and reuse for next season.

To achieve above objects, the present invention provides a hanging unit having a plurality of vertical rods which are arranged approximately in parallel; wherein at top of each rod is connected with an upper wire; and at lower end of each rod is connected with a lower wire; each vertical rod is installed with a plurality of clips or other fastening devices; a plurality of upper support clips are arranged on the upper wire; and a lower stabilizing clip which has a connecting wire for connecting the lower end to siding or soffit. The upper wire and lower wire are made of flexible materials for easy installation around the corner and easy folding away storage. The upper support clip has two clamping tongues and a wire organizing space which has flexible notch to receive and release both electrical and upper wires; the vertical rod have a series of clips or other fastening devices to connect the vertical electrical wire to rod. The fastening devices on the rod can be clips of elastic C rings, adhesive tapes, velcro, snap-on clip or flexible string.

The various objects and advantages of the present invention will be more readily understood from the following detailed description when read in conjunction with the attached drawing.

DETAILED DESCRIPTION OF THE INVENTION

In order that those skilled in the art can further understand the present invention, a description will be provided in the following details. However, these descriptions and the attached drawings are only used to cause those skilled in the art to understand the objects, features, and characteristics of the present invention, but not to be used to confine the scope and spirit of the present invention defined in the appended claims.

Figure 1:
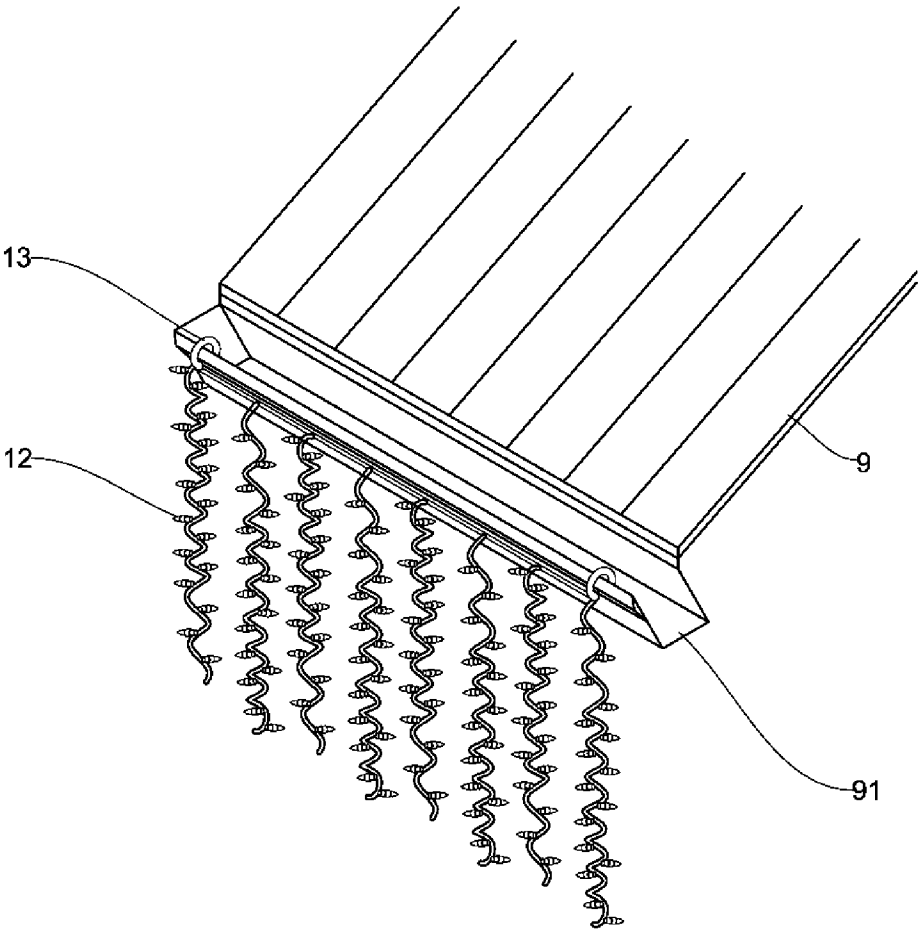
Fig. 1 PRIOR ART
FIG. 1 is a perspective view of prior art of hanging the Icicle lights.
Figure 2:
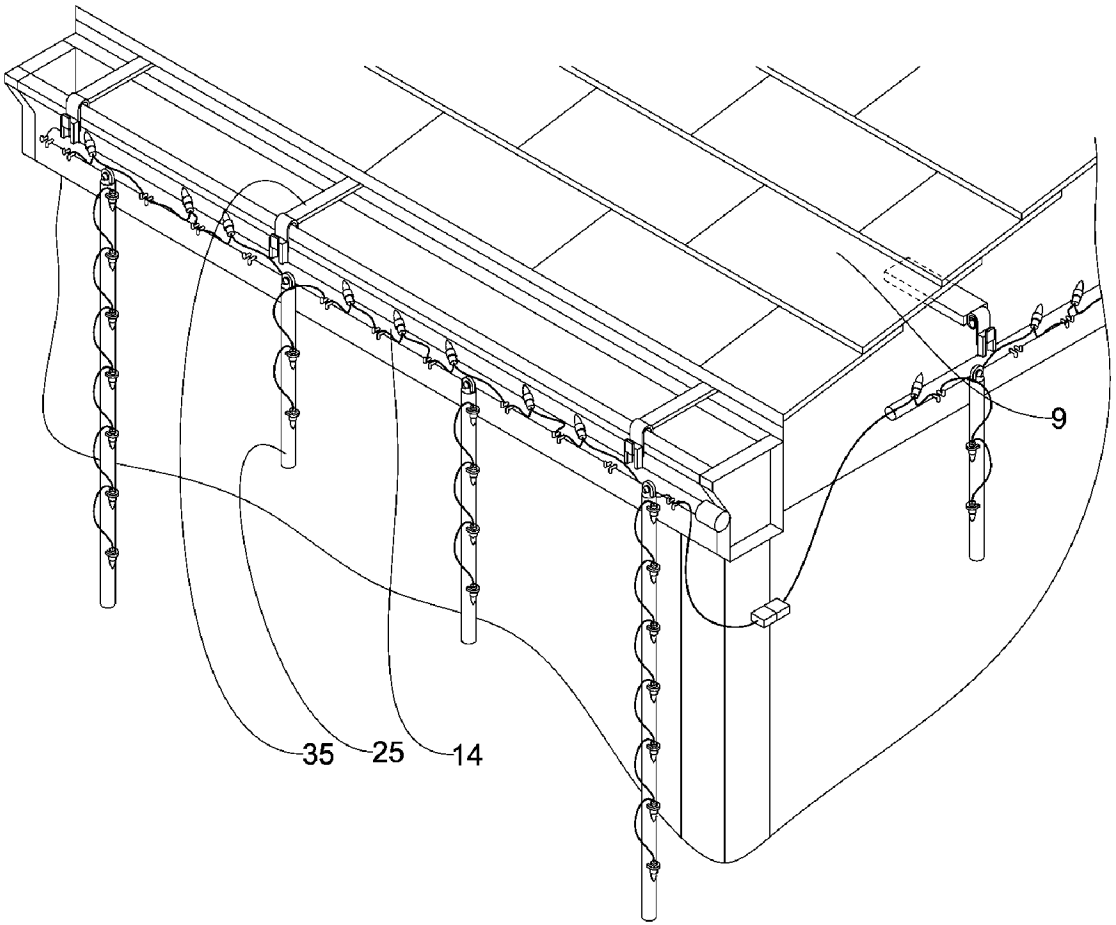
Fig. 2 PRIOR ART
FIG. 2 is a schematic view about a U.S. Pat. No. 6,076,938.
Figure 3:
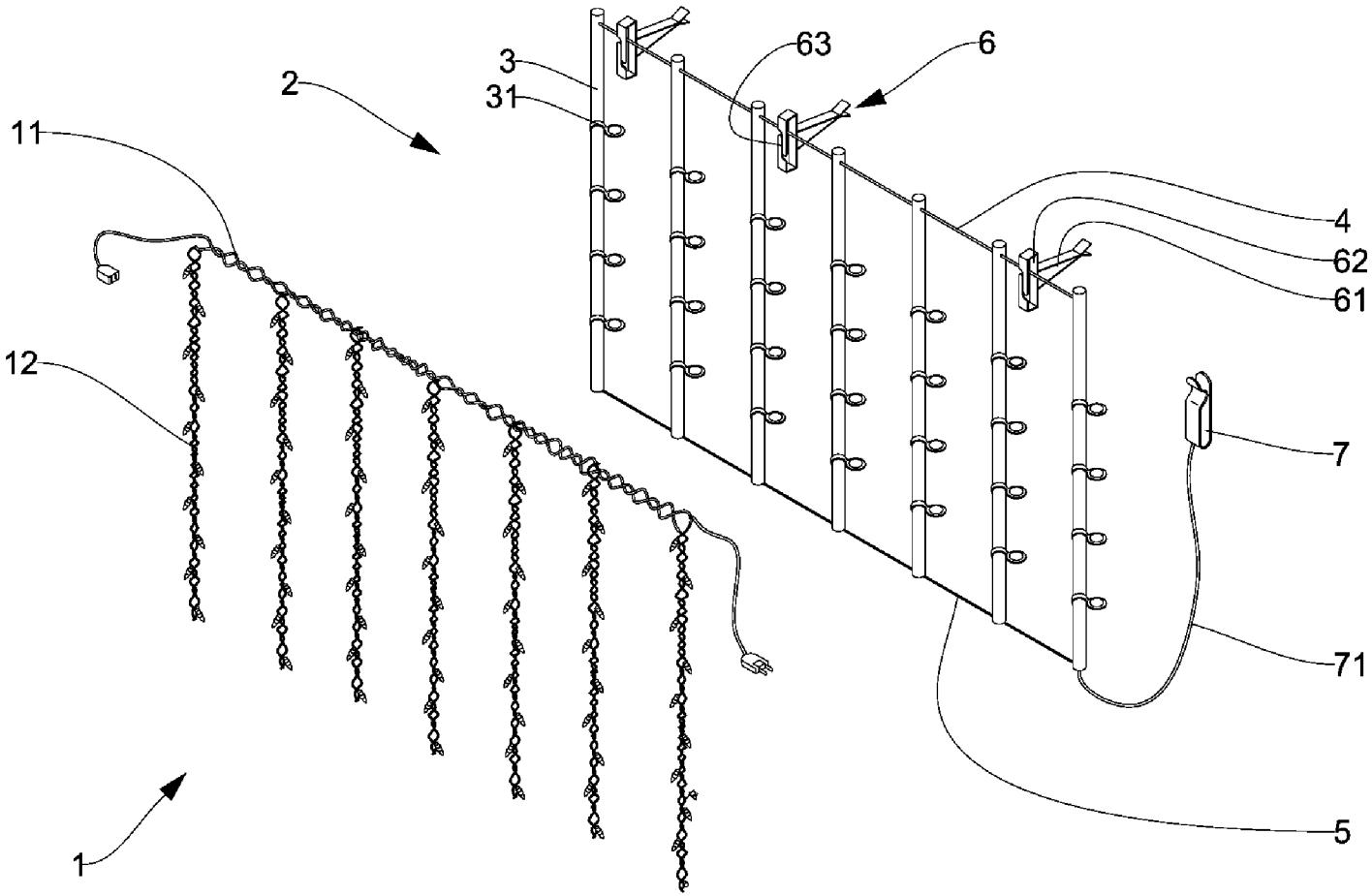
FIG. 3 is an exploded perspective view of the present invention.

Referring to FIG. 3, the hanging assembly for Icicle lights of the present invention is illustrated. The present invention has the following elements for the installation and organization of Icicle lights 1.

A hanging unit 2 includes a plurality of rods 3 which are arranged vertically. On a top of each rod 3 is connected to an upper wire 4. A lower end of each rod 3 is connected to a lower wire 5. The upper wire 4 and lower wire 5 are made of flexible material for easy installation around the corner and easy folding away storage. A plurality of clips or fastening devices 31 are installed on each rod 3. Each upper wire 4 is installed with a plurality of upper support clips 6. Each upper support clip 6 has two clamping tongues 61 and a wire organizing space 62 which has a flexible notch 63 to receive and release electrical and upper wires. A lower stabilizing clip 7 has a wire 71 to connect to extension board, soffit or siding to stabilize the lower end of the Icicle lights.

Figure 4:
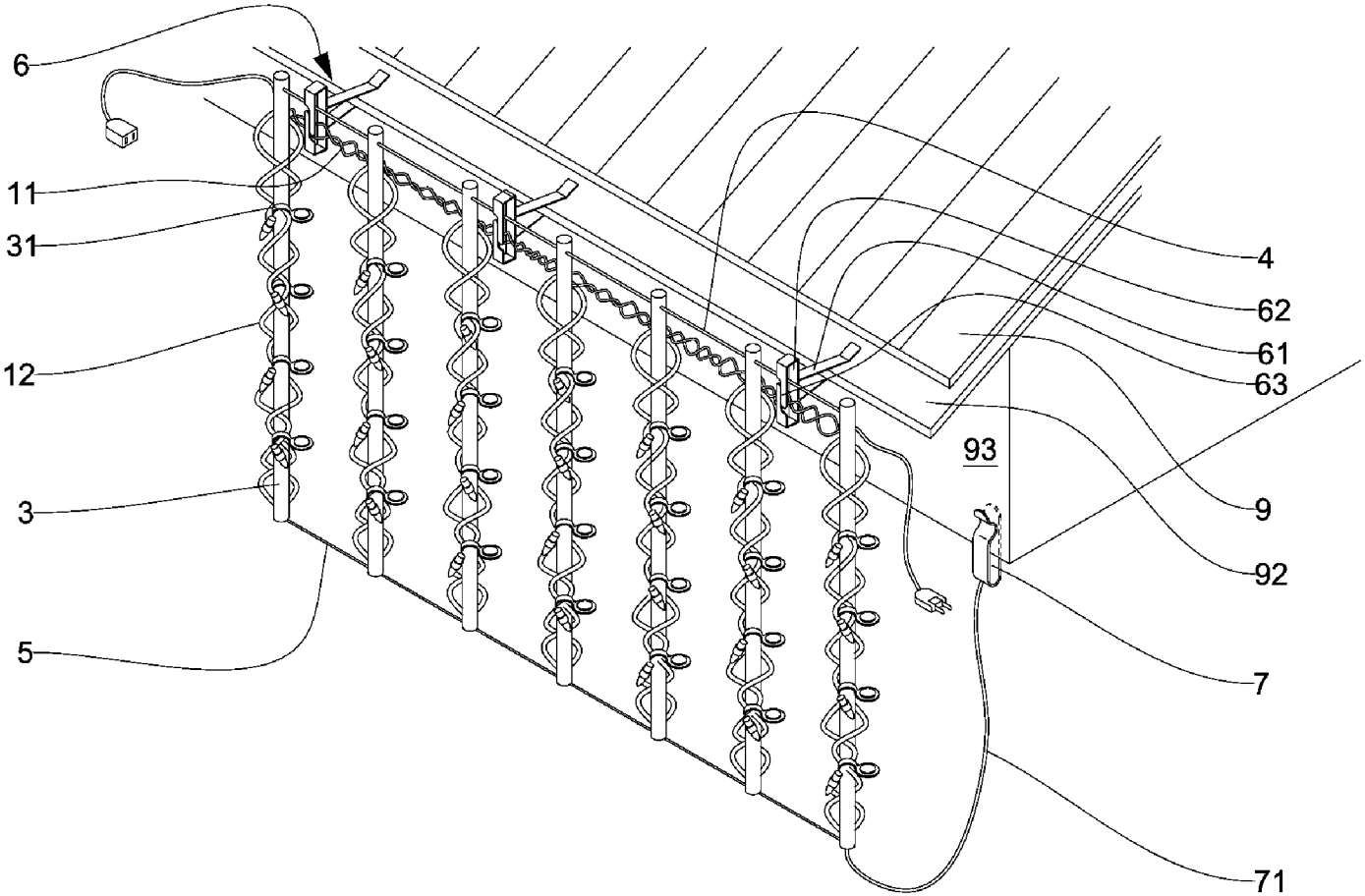
FIG. 4 shows the use of the present invention.

With reference to FIGS. 3 and 4, when it is desired to install an Icicle lights on the edge of roof 9. The upper wire 4 and the horizontal electrical wire 11 pass through the retaining space 62 of the upper support clip 6. Then the plurality of vertical electrical wire 12 are retained to the rods 3 by using the clips or other fastening devices 31. This also make the vertical light steams hang straight. Thus the Icicle lights are completely retained to the hanging unit 2. Then the upper support clip tongues 61 engage to a shingle plate 92. The lower stabilizing clip 7 is clipped to an extension plate, soffit or siding 93. Therefore, the Icicle lights 1 and the hanging unit 2 are attached to the edge of the roof 9. When strong winds blow, the Icicle lights will not intertwined disorderly. Furthermore, by the lower stabilizing clip 7 to attach to extension plate 93, the lights will not flip-up onto the roof.

Figure 5:
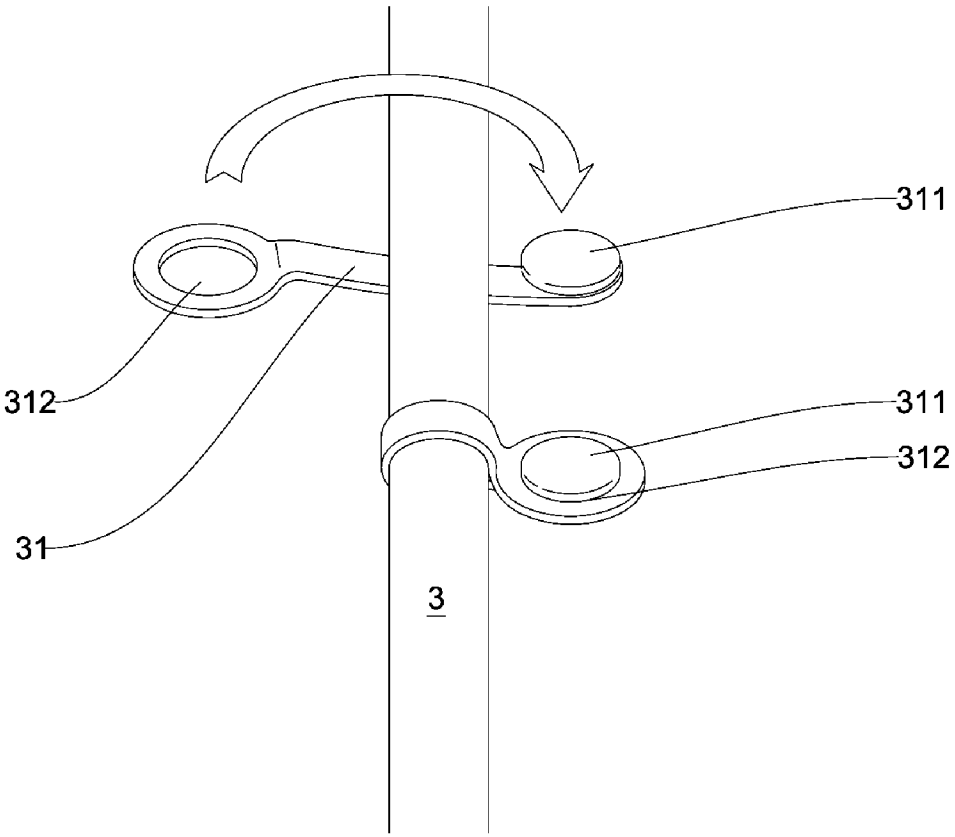
FIG. 5 shows one embodiment of the snap-on clip of the present invention.
Figure 6:
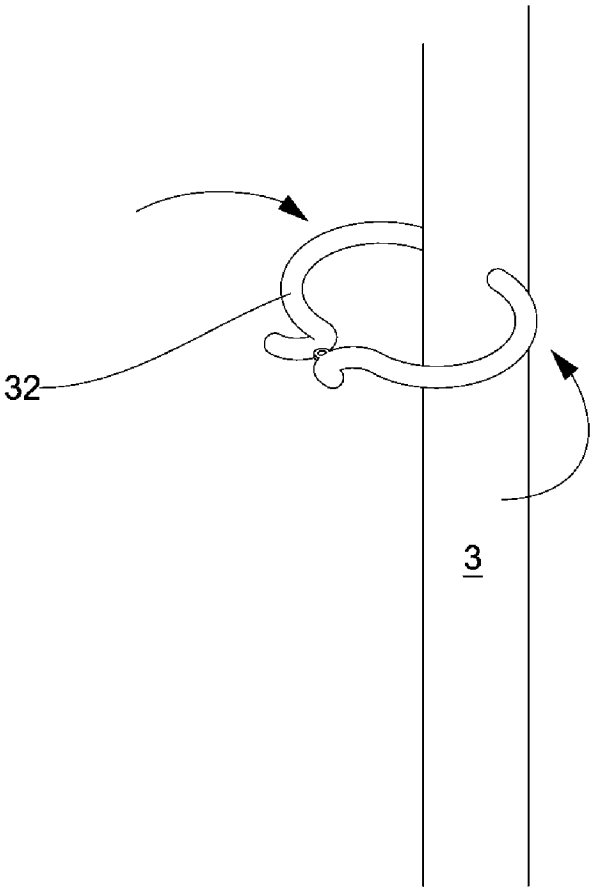
FIG. 6 shows another embodiment of using clips of elastic C rings.
Figure 7:
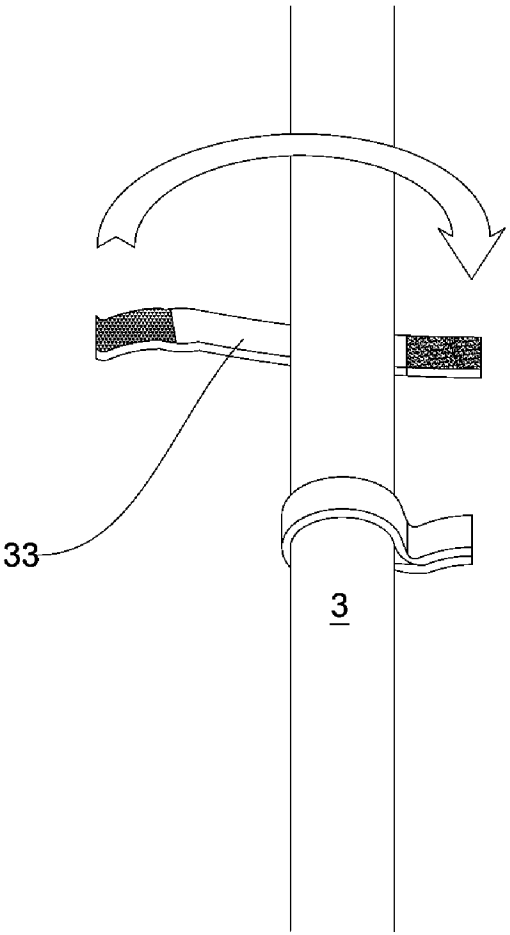
FIG. 7 shows another embodiment of using adhesive tape or velcro.
Figure 8:
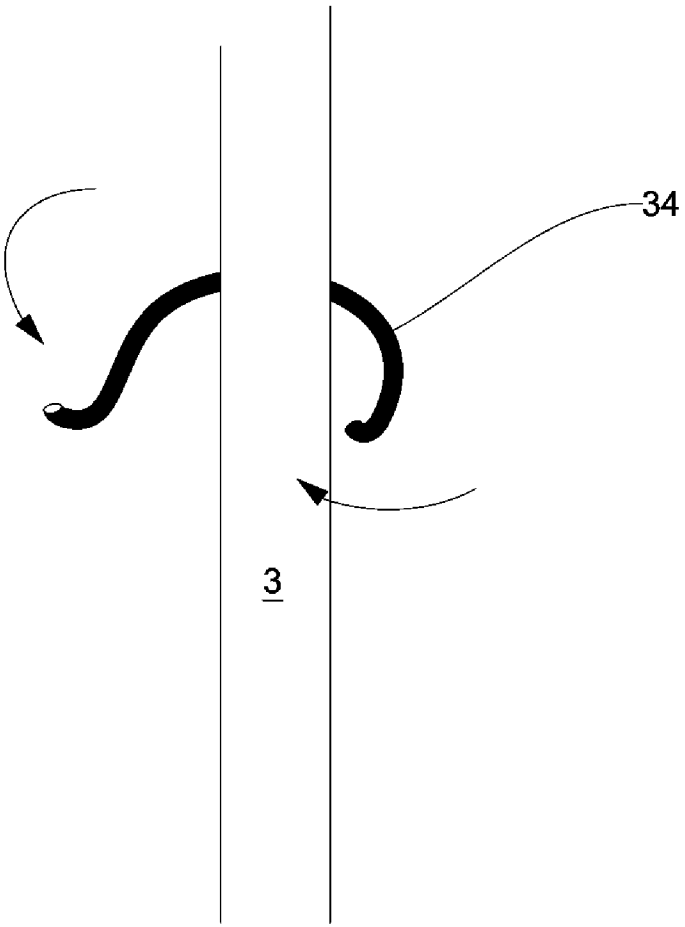
FIG. 8 shows another embodiment of using string or wire as fastening device.

Referring to FIG. 5, this embodiment of the present invention is illustrated. Each snap-on clip 31 includes a button 311 and a receiving slot 312. When the button portion 311 and the receiving slot 312 are engaged, they form a retaining ring. Referring to FIG. 6, the clips on rod 3 are elastic C rings 32. Referring to FIG. 7, the fastening devices on the rod 3 are adhesive tapes or velcro. Furthermore, as shown in FIG. 8, the fastening devices on rod 3 are flexible strings 34.

Figure 9:
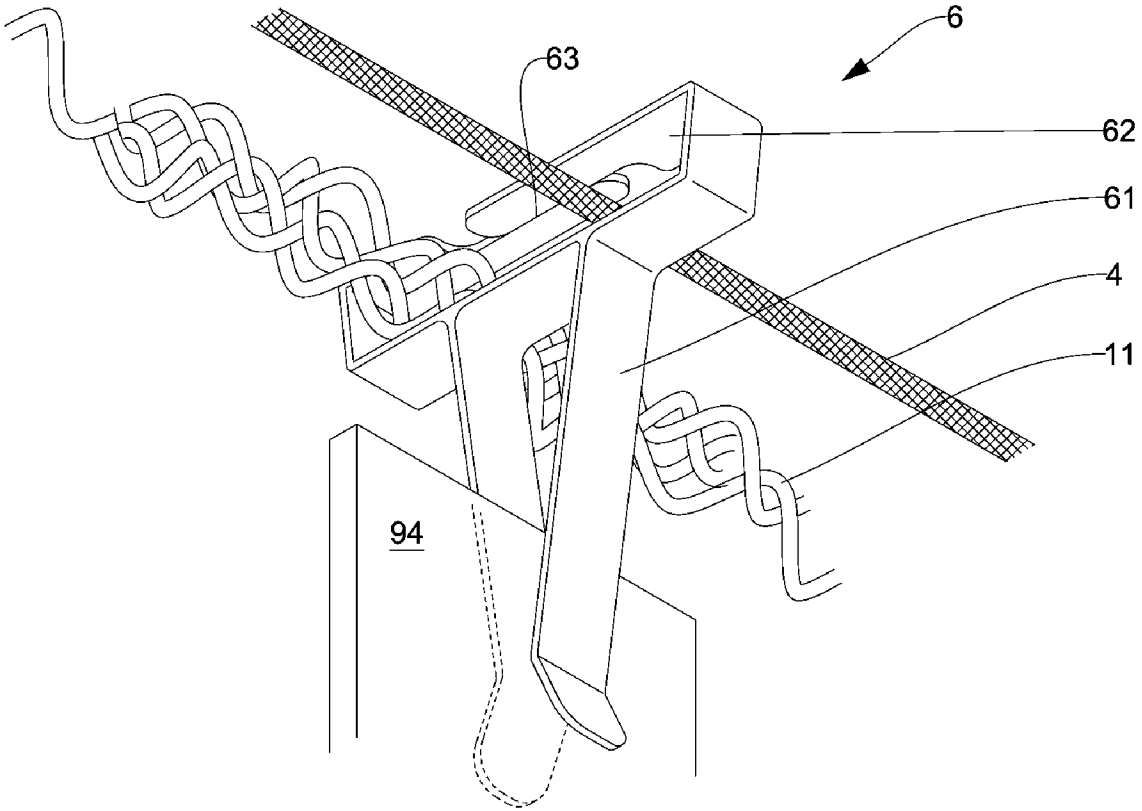
FIG. 9 shows the application of the upper support clip of the present invention to engage gutter vertically.
Figure 10:
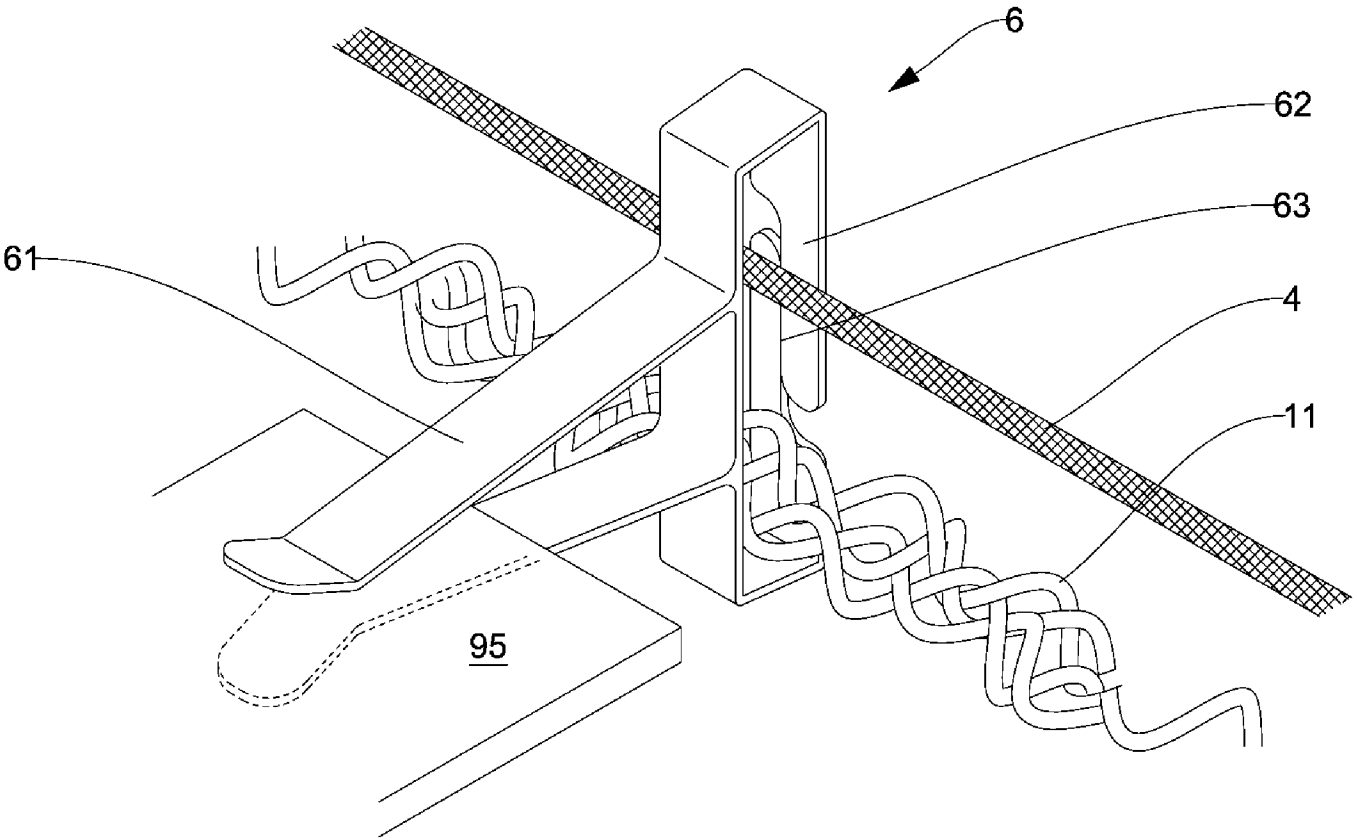
FIG. 10 shows another application of the upper support clip of the present invention to engage shingle.

The upper support clip 6 of the present invention is a universal and all directional clip. It can be arranged transversally or longitudinally. As shown in FIG. 9, when it is desired to engage the upper support clip 6 vertically to gutter or a plate, the two clamping tongues 61 are inserted from the upper side to the lower side. Referring to FIG. 10, when it is desired to assemble the upper support clip 6 to a transversal plate 95, two clamping tongues 61 can be arranged transversally. This upper support clip can also engage to shingle, gutter, tree limbs, fences and even sidings.

Figure 11:
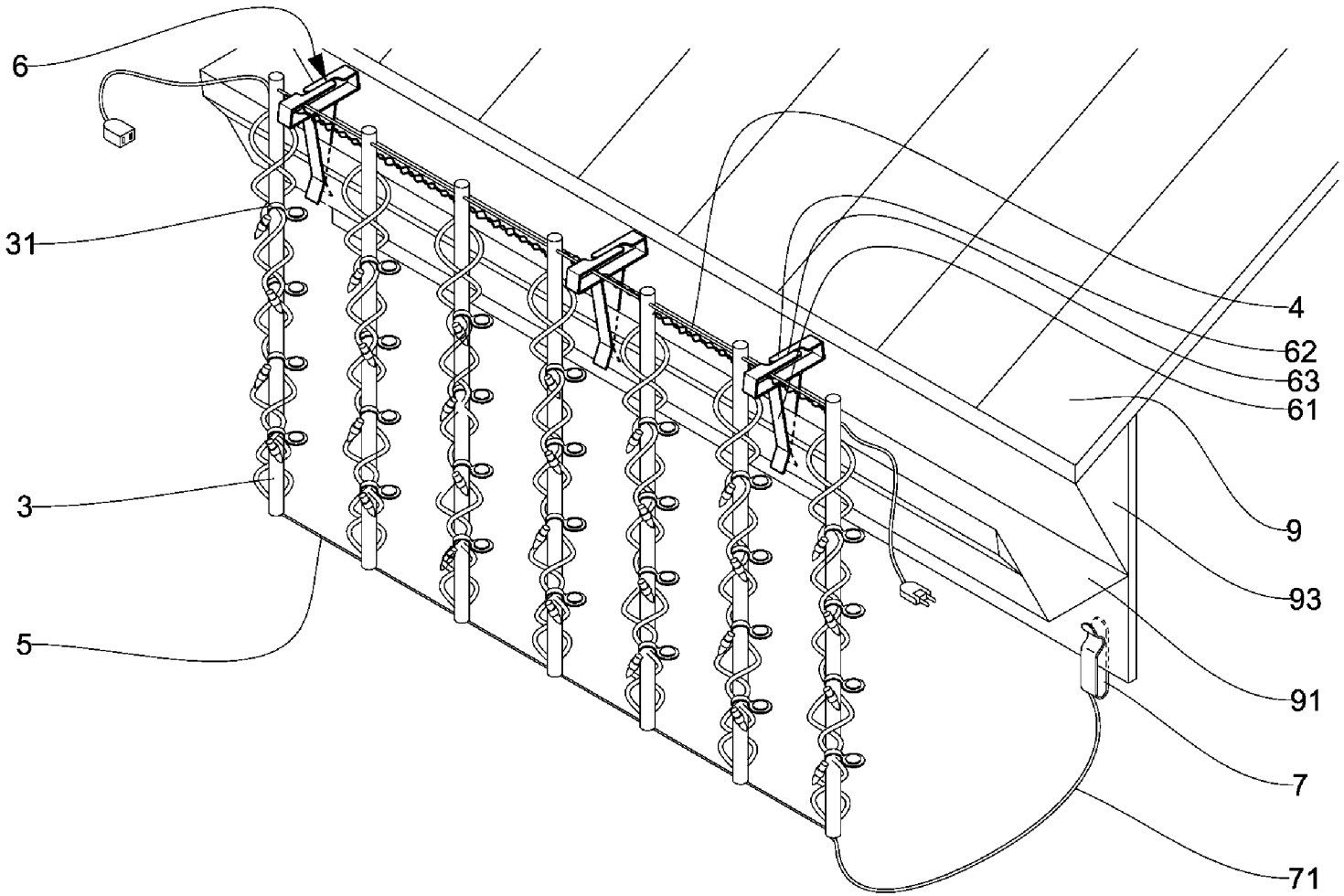
FIG. 11 shows that the present invention is used to install Icicle lights on gutter.

Referring to FIG. 11, when the present invention is desired to install with the gutter 91, the upper support clip 6 is clipped to the lateral plate 91 and the lower stabilizing clip 7 is attached to the extension plate 93. Therefore, the Icicle lights 1 and the hanging unit 2 are well assembled to the gutter of a roof 9.

The present invention is thus described; it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An organizing and installation device for Icicle lights with a hanging assembly, comprising:

a hanging unit having a plurality of rods which are arranged vertically and substantially in parallel, wherein on a top of each rod is connected with an upper wire, and a lower end of each rod is connected with a lower wire, and each rod is installed with a plurality of clips;

a plurality of upper support clips arranged on the upper wire; and a lower stabilizing clip which has a connecting wire for connecting the lower stabilizing clip to the lower wire or rod wherein the upper support clip has two clamping tongues and a wire organizing space, the wire organizing space has a flexible notch to receive and release electrical and upper wires, and the upper support clip engages shingle, gutter, tree limbs, fences and sidings.

2. This device as claimed in claim 1, wherein the upper wire and lower wire are made of flexible materials for easy installation around the corner and easy folding away storage.

3. This device as claimed in claim 1, wherein the clips on the rod are elastic C rings.

4. This device as claimed in claim 1, further comprising a fastening device which is adhesive a tape, velcro or flexible string on the rod.

5. This device as claimed in claim 1, further comprising a fastening device which is a snap-on clip on the rod.

* * * * *